US010350919B2

(12) United States Patent
Kodaira

(10) Patent No.: US 10,350,919 B2
(45) Date of Patent: Jul. 16, 2019

(54) LARGE FORMAT PRINTER

(71) Applicant: SEIKO EPSON CORPORATION, Tokyo (JP)

(72) Inventor: Kazushi Kodaira, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/993,778

(22) Filed: May 31, 2018

(65) Prior Publication Data

US 2018/0345696 A1 Dec. 6, 2018

(30) Foreign Application Priority Data

Jun. 2, 2017 (JP) ..... 2017-109801

(51) Int. Cl.
*B41J 19/00* (2006.01)
*B41J 2/045* (2006.01)

(52) U.S. Cl.
CPC ..... *B41J 19/005* (2013.01); *B41J 2/0455* (2013.01); *B41J 2/0457* (2013.01); *B41J 2/04541* (2013.01); *B41J 2/04548* (2013.01); *B41J 2/04581* (2013.01); *B41J 2/04588* (2013.01); *B41J 2/04593* (2013.01); *B41J 2/04596* (2013.01)

(58) Field of Classification Search
CPC .... B41J 2/04548; B41J 2/0455; B41J 2/0457; B41J 2/04511; B41J 2/04541
See application file for complete search history.

(56) References Cited

U.S. PATENT DOCUMENTS

| | | | | |
|---|---|---|---|---|
| 7,084,996 | B2 | 8/2006 | Kubo | |
| 9,016,833 | B2 | 4/2015 | Ito et al. | |
| 2011/0122179 | A1* | 5/2011 | Hoisington | B41J 2/0451 347/9 |
| 2015/0069934 | A1* | 3/2015 | Gardner | H02N 2/0075 318/116 |
| 2015/0174896 | A1* | 6/2015 | Ieiri | B41J 2/04541 347/10 |

FOREIGN PATENT DOCUMENTS

| | | |
|---|---|---|
| JP | 2002-019106 A | 1/2002 |
| JP | 2014-133358 A | 7/2014 |

* cited by examiner

*Primary Examiner* — Julian D Huffman

(57) ABSTRACT

A large format printer performs serial printing on a medium which is greater than or equal to A3 short side width. The large format printer includes a print head which performs printing in accordance with variations in a drive voltage signal which is applied to a drive element, a control circuit which generates a drive signal (an example of the drive voltage signal), and a cable which is greater than or equal to 1 m and transmits a power voltage signal (an example of a constant voltage signal) and the drive voltage for driving the print head from the control circuit to the print head. An overshooting prevention circuit which renders a voltage (a drive voltage) of the drive signal which is applied to the drive element less than or equal to a voltage (a power voltage) of the power voltage signal is disposed in the print head.

10 Claims, 8 Drawing Sheets

RD

| (SIH, SIL) | T1 | | T2 | |
|---|---|---|---|---|
| | Sa | Sb | Sa | Sb |
| (1, 1) [LARGE DOT] | H | L | H | L |
| (1, 0) [MEDIUM DOT] | H | L | L | H |
| (0, 1) [SMALL DOT] | L | L | L | H |
| (0, 0) [NON-RECORDING] | L | H | L | L |

LARGE FORMAT PRINTER

This application claims priority to Japanese Patent Application No. 2017-109801 filed on Jun. 2, 2017. The entire disclosure of Japanese Patent Application No. 2017-109801 is hereby incorporated herein by reference.

BACKGROUND

1. Technical Field

The present invention relates to a large format printer which performs serial printing on a medium of a large format size (for example, a size greater than or equal to A3 short side width) in which a print head moves reciprocally in a scanning direction.

2. Related Art

JP-A-2014-133358 discloses an ink jet type printer in which a control signal and a drive signal are supplied from a control substrate which is attached to a housing of a printing apparatus to a print head via a flexible cable (an example of a cable) and the print head which moves reciprocally discharges droplets based on the drive signal to perform serial printing. JP-A-2002-19106 discloses a recording apparatus in which a carriage, on which is installed a print head and a drive circuit (a carriage substrate) which generates a drive pulse and applies the drive pulse to the print head, moves reciprocally, where the recording apparatus performs recording of an image by discharging droplets from the print head. The drive circuit of the print head side is connected to the control circuit (the control substrate) of the main body side via a flexible cable and drives the print head based on the drive signal which is received from the control circuit via the flexible cable.

Incidentally, in a large format printer (LFP) capable of serial printing on a medium which is greater than or equal to A3 short side width, a movement distance of the print head increases and the cable which connects the print head to the control substrate (the control circuit) may be greater than or equal to 1 m. The longer the cable, the greater the inductance and the impedance of a signal line inside the cable and the crosstalk between drive signals increases. Therefore, in a large format printer, in a case in which, in the printers which are disclosed in JP-A-2014-133358 and JP-A-2002-19106, in a case in which the drive signal is supplied from the control circuit to the print head, overshooting of the drive signal is easily increased. As a result, there is a concern that, depending on the overshooting of the drive signal, an overvoltage which exceeds a withstand voltage (a rated voltage) is momentarily applied to circuits or drive elements which are installed in the print head and the print head is damaged. When the drive signal in which the overshooting occurs is applied to the print head, erroneous operations such as decreases in printing precision and printing stability or erroneous discharging of droplets occur more easily and disruption to print quality may occur.

SUMMARY

An advantage of some aspects of the invention is to provide a large format printer capable of reducing at least one problem such as damage to the print head and disruption to print quality which originates in the cable being long.

Hereinafter, means of the invention and operation effects thereof will be described.

According to an aspect of the invention, there is provided a large format printer capable of serial printing on a medium which is greater than or equal to A3 short side width including a print head which performs printing in accordance with variations in a drive voltage signal which is applied to a drive element, a control circuit which generates the drive voltage signal, and a cable which is greater than or equal to 1 m and transmits a constant voltage signal and the drive voltage signal for driving the print head from the control circuit to the print head, in which an overshooting prevention circuit which renders a voltage of the drive voltage signal which is applied to the drive element less than or equal to a voltage of the constant voltage signal is disposed in the print head.

In this configuration, it is possible to suppress the voltage of the drive voltage signal which is applied to the drive element to less than or equal to the voltage of the constant voltage signal using the overshooting prevention circuit. As a result, it is possible to suppress the overshooting which occurs in the process of the drive voltage signal being propagated on the cable. Accordingly, it is possible to reduce at least one problem such as damage to the print head and disruption to print quality which originates in the cable being long.

In the large format printer, it is preferable that the overshooting prevention circuit include a voltage dividing circuit which receives an input of the constant voltage signal, subject the voltage of the constant voltage signal to voltage division, and output a voltage-divided voltage signal of a voltage which is less than or equal to the voltage of the constant voltage signal, and that the overshooting prevention circuit render the voltage of the drive voltage signal which is applied to the drive element less than or equal to the voltage of the voltage-divided voltage signal.

In this configuration, it is possible to suppress the voltage of the drive voltage signal which is applied to the drive element to less than or equal to the voltage of the voltage-divided voltage signal which is obtained by subjecting the voltage of the constant voltage signal to voltage division. Accordingly, it is possible to effectively reduce the overshooting.

In the large format printer, it is preferable that a first diode for preventing a current from flowing backward be disposed at a terminal to which the constant voltage signal is input in the overshooting prevention circuit.

In this configuration, it is possible to prevent a current from flowing backward in the overshooting prevention circuit when the overshooting occurs (the voltage of the drive voltage signal>the voltage of the constant voltage signal).

In the large format printer, it is preferable that a second diode for preventing a current from flowing backward be disposed at a terminal to which the drive voltage signal is input in the overshooting prevention circuit.

In this configuration, it is possible to prevent a current from flowing backward in the overshooting prevention circuit during ordinary operation when the overshooting does not occur (the voltage of the drive voltage signal≤the voltage of the constant voltage signal) using the second diode.

It is preferable that the large format printer further include a transistor including terminals to which the voltage-divided voltage signal and the drive voltage signal are input, in which a third diode for protection may be disposed at a terminal to which the voltage-divided voltage signal is input in the transistor.

In this configuration, it is possible to prevent the voltage (the voltage of the voltage-divided voltage signal) which is input to the transistor from the voltage dividing circuit from becoming excessively higher than the voltage of the drive voltage signal which is input from the other terminal of the transistor. Accordingly, it is possible to protect the transistor using the third diode.

In the large format printer, it is preferable that the voltage dividing circuit be configured such that the voltage of the voltage-divided voltage signal is variable.

In this configuration, since the value of the voltage-divided voltage signal is variable, for example, it is possible to appropriately suppress the overshooting for every waveform of the drive voltage signal, it is possible to suppress the overshooting according to the irregularities of the waveforms of the drive voltage signal which originate in manufacturing irregularities in the print head, and the like.

In the large format printer, it is preferable that the drive voltage signal include a plurality of waveforms, and that the voltage dividing circuit change a voltage value of the voltage-divided voltage signal to a value corresponding to a waveform for every one of the waveforms of the drive voltage signal.

In this configuration, it is possible to appropriately suppress the overshooting for every one of a plurality of waveforms which are included in the drive voltage signal.

In the large format printer, it is preferable that a maximum width over which the serial printing is possible be 24 inches to 75 inches.

In this configuration, even if the cable is long to the extent that the serial printing is possible at the maximum width of 24 inches to 75 inches, it is possible to effectively suppress the occurrence of the overshooting in the drive voltage signal in the process of the drive voltage signal being propagated on the cable.

In the large format printer, it is preferable that the maximum width over which the serial printing is possible be any one of 24 inches, 36 inches, 44 inches, and 64 inches.

In this configuration, even if the cable is a comparatively long cable which supports the serial printing of 24 inches, 36 inches, 44 inches, and 64 inches, it is possible to effectively suppress the occurrence of the overshooting in the drive voltage signal in the process of the drive voltage signal being propagated on the cable.

In the large format printer, it is preferable that the print head discharge a liquid at a frequency greater than or equal to 30 kHz to perform printing.

In this configuration, even if the large format printer is configured such that the print head discharges a liquid at a frequency greater than or equal to 30 kHz, the drive voltage signal which is propagated on the flexible cable has a high frequency, and the overshooting occurs easily in the process of propagation, it is possible to effectively suppress the overshooting which occurs using the overshooting prevention circuit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
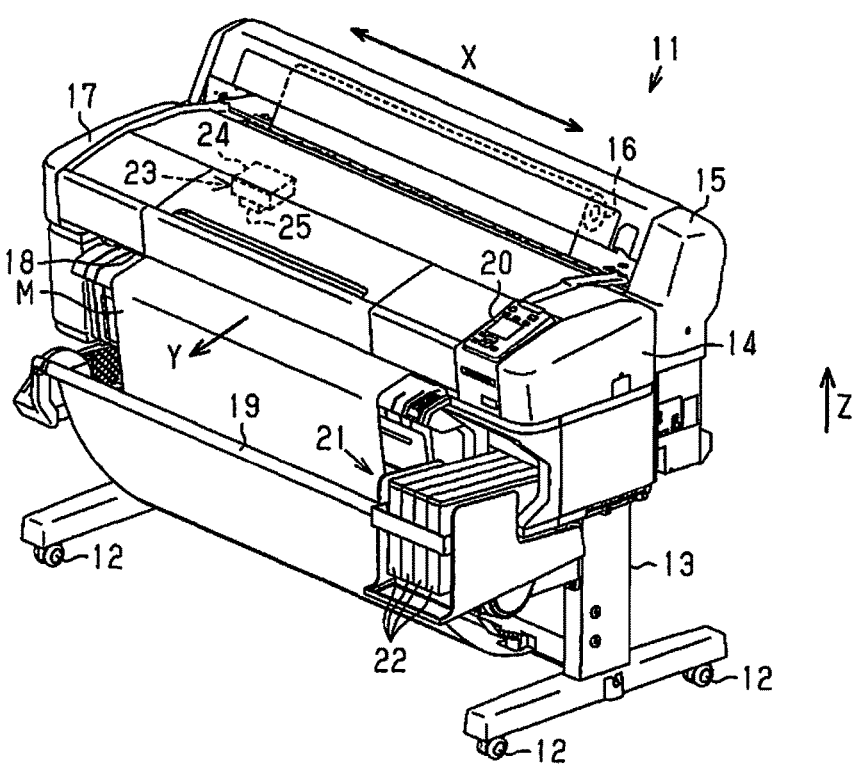
FIG. 1 is a schematic perspective diagram of a large format printer in an embodiment.

Hereinafter, an embodiment that embodies the large format printer will be described with reference to the drawings. As illustrated in FIG. 1, a large format printer 11 of the present embodiment is a serial type (a serial printing type) of printer. The large format printer 11 is an ink jet printer which forms a dot group on a medium M (a printing medium) such as a paper or a film by discharging droplets (for example, an ink) according to image data which is supplied from an external host computer, for example, and thus prints an image (including characters, pictures, and the like). In the present embodiment, in the large format printer 11, a movement direction of a carriage 24 (described later) is described as a main scanning direction X, a transport direction of the medium M is described as a sub-scanning direction Y, and a vertical direction (vertically upward facing (a height direction) in the example of FIG. 1) is described as Z. The main scanning direction X, the sub-scanning direction Y, and the vertical direction Z are denoted in the drawings as three orthogonally intersecting axes. However, the dispositional relationship of the configurations is not limited to being orthogonally intersecting.

In the present embodiment, the large format printer is a printer capable of performing serial printing on the medium M which is greater than or equal to A3 short side width (297 mm), in other words, is a printer capable of serial printing at a printing width greater than or equal to A3 short side width. Therefore, in the large format printer 11, a head unit 23 which is illustrated in FIG. 1 is capable of moving reciprocally in the main scanning direction X across a movement range in which serial printing is possible at a printing width greater than or equal to A3 short side width.

First, a description will be given of the schematic configuration of the large format printer 11 with reference to FIG. 1. As illustrated in FIG. 1, the large format printer 11 includes a support stand 13 and a substantially rectangular parallelepiped apparatus main body 14 (hereinafter also referred to simply as "the main body 14"). Wheels 12 are attached to the bottom ends of the support stand 13 and the apparatus main body 14 is supported by the support stand 13. A roll body 16 (for example, rolled paper or the like) in which the medium M such as long paper or film is wound in multiple layers in a cylindrical shape is loaded into the inside of a feed unit 15 which protrudes upward at the rear portion of the main body 14. The medium M which is fed out from the feed unit 15 is introduced into the inside of a housing 17 of the main body 14 and is transported by a transport device (a transport unit) (not illustrated) which is provided inside the housing 17. An image is printed onto the medium M due to the head unit 23 discharging droplets (for example, ink droplets) onto the medium M which is transported by the transport device. The medium M after printing is output from an output port 18 which is open on the front surface side of the housing 17 and is received by a medium receiving unit 19 which is attached under the output port 18.

An operation panel 20 for the user to perform setting operations and input operations of the large format printer 11 is attached to a top surface end portion of the main body 14. A liquid storage unit 21 is provided on one end bottom portion of the main body 14. A plurality of (in the example of FIG. 1, four) liquid storage portions 22 (for example, ink cartridges or ink tanks), which store inks which serve as examples of the liquid, are attached to the liquid storage unit 21 in a state of being attachable and detachable. Each of the plurality of liquid storage portion 22 stores a different type (for example, color) of the liquid (for example, ink). In an example in which the liquids are inks, a plurality of greater than or equal to four of the liquid storage portions 22 are provided in which one of each of a plurality of colors of ink are stored. The colors of the ink include, for example, black (K), cyan (C), magenta (M), and yellow (Y). In the example of FIG. 1, the four liquid storage portions 22 corresponding to the four colors are illustrated. However, for example, greater than or equal to five of the liquid storage portions 22 including at least one liquid storage portion 22 corresponding to another color such as gray, green, violet, or the like may be provided.

The head unit 23 which discharges droplets (ink droplets) onto the medium M and performs printing on the medium M is provided inside the housing 17. The head unit 23 includes the carriage 24 and a print head 25 which is installed on the carriage 24 to face the medium M. The carriage 24 is stored in a state of being capable of moving reciprocally in the main scanning direction X inside the main body 14. The colored liquids (inks) are supplied from the liquid storage portions 22 to the head unit 23 through tubes (not illustrated). The large format printer 11 is not limited to an off-carriage type configuration in which the liquid storage unit 21 is attached to the main body 14, and may have an on-carriage type configuration in which the plurality of liquid storage portions 22 are attached to the carriage 24.

Figure 2:
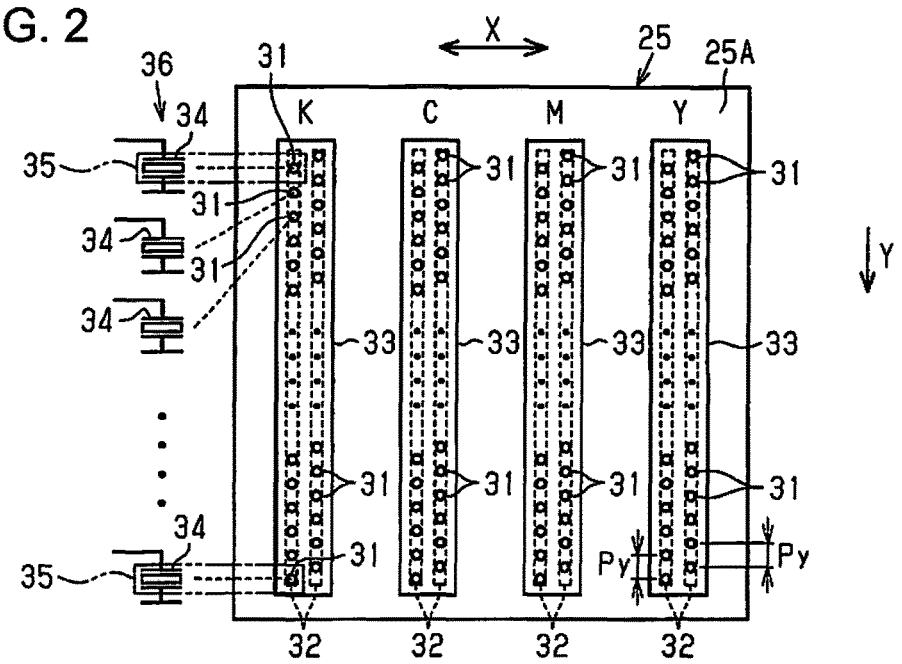
FIG. 2 is a schematic diagram illustrating a discharge surface and drive elements of a print head.

Next, a description will be given of the print head 25 with reference to FIG. 2. FIG. 2 illustrates a discharge surface 25A (a nozzle opening surface), in which multiple nozzles 31 capable of discharging droplets are opened, in the print head 25. As illustrated in FIG. 2, four nozzle plates 33 are provided to line up along the main scanning direction X on the discharge surface 25A of the print head 25. Each of the nozzle plates 33 includes two (two rows of) nozzle rows 32. Multiple nozzles 31 are lined up at a predetermined pitch Py (a nozzle pitch) along the sub-scanning direction Y in each of the nozzle rows 32. A number F of the nozzles 31 per single nozzle row is a value (for example, 400) within a range of 100 to 600, for example. In the two nozzle rows 32 which are provided in each of the nozzle plates 33, the relationship between the nozzles 31 is shifted by half of the pitch Py in the sub-scanning direction Y. In the present embodiment, eight of the nozzle rows 32 are provided on the discharge surface 25A. In the example illustrated in FIG. 2, the two nozzle rows 32 that are provided in the same nozzle plate 33 discharge the same color of ink and printing by discharging of the four colors of black (K), cyan (C), magenta (M), and yellow (Y) is possible at a high resolution corresponding to ½ the distance of the nozzle pitch Py in the sub-scanning direction Y. Greater than or equal to five (for example, six or eight) of the nozzle plates 33 may be provided on the print head 25. A configuration may also be adopted in which only a single row of the nozzle rows 32 is provided on the nozzle plate 33, a single nozzle row 32 is caused to correspond to a single color, and the print head 25 is capable of discharging the liquid at a resolution corresponding to the nozzle pitch Py.

As illustrated in FIG. 2, the same number of drive elements 34 as the number of nozzles 31 are embedded in the print head 25. In FIG. 2, a portion of the drive elements 34 is schematically rendered on the outside of the print head 25. However, in actuality, the drive elements 34 are disposed at positions facing the nozzles 31. A single discharge unit 35 is configured by a single nozzle 31 and a single drive element 34 which form a group. The same number of (in the example of FIG. 2, eight) discharge unit groups 36 as the number of nozzle rows 32 are provided in the print head 25 (however, only the single discharge unit group 36 is illustrated in FIG. 2). Each of the discharge unit groups 36 is formed from the same number of discharge units 35 as the number F of the nozzles 31 per single nozzle row, for example.

Each of the drive elements 34 illustrated in FIG. 2 is configured by a piezoelectric element, for example. When a drive signal (a drive voltage) having a predetermined waveform (described later) is applied to the drive element 34, a diaphragm which configures a portion of an inner wall portion of a cavity which communicates with the nozzle 31 is caused to vibrate by an electrostriction effect, the cavity is expanded and constricted, and so a droplet is discharged from the nozzle 31. As long as the drive element 34 is driven by the application of a drive signal (a drive voltage), besides a piezoelectric element, the drive element 34 may be an electrostatic drive element which is driven by an electrostatic effect, and further, may be a heater element which uses the pressure (expansion pressure) of a bubble which is generated by heating and boiling a liquid (an ink) to discharge a droplet from a nozzle. In this manner, the print head 25 may be any of a piezoelectric drive type, an electrostatic drive type, or a thermal drive type.

The number of the discharge unit groups 36 which are included in the print head 25 may be changed to a suitable value in a range greater than or equal to two (for example, 2 to 30), and further, may be one. In the present embodiment, the single discharge unit group 36 is configured by a group of the discharge units 35 to which a single drive signal is transmitted in common. Although the single discharge unit group 36 is configured by a number of the discharge units 35 that is sufficient for the single nozzle row 32, the single discharge unit group 36 may be configured by a number of the discharge units 35 that is sufficient for two of the nozzle rows 32 (for example, sufficient for one color). A configuration may also be adopted in which the single discharge unit group 36 is configured by a number of the discharge units 35 that is fewer than the number of nozzles that is sufficient for the single nozzle row, a single drive signal is transmitted to a portion of the discharge units 35 (one of the discharge unit groups 36) in the single nozzle row 32, and another drive signal is transmitted to the remaining other portion of the discharge units 35 (another one of the discharge unit groups 36).

Figure 3:
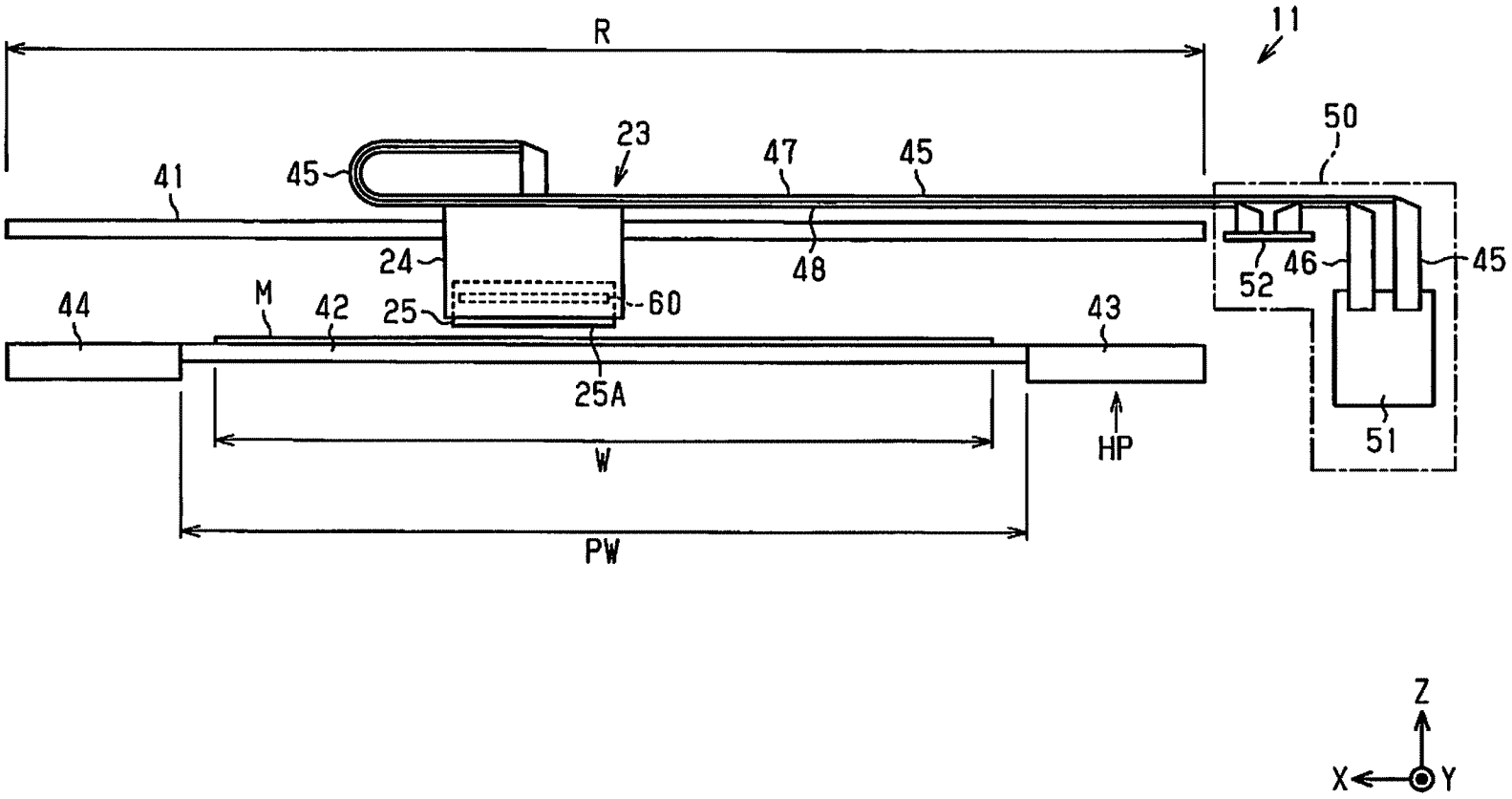
FIG. 3 is a schematic front diagram illustrating a situation in which a control circuit and the print head are connected to each other by a cable.

FIG. 3 illustrates a schematic internal configuration of a portion at which the serial printing is performed in the large format printer 11 as viewed from the downstream side in the sub-scanning direction Y. As illustrated in FIG. 3, the large format printer 11 is provided with the head unit 23, a guide shaft 41, a support stand 42, a capping mechanism 43, and a maintenance mechanism 44.

The head unit 23 moves (reciprocal movement) in the main scanning direction X in a range of a movable region R along the guide shaft 41 based on the control of a carriage movement mechanism (not illustrated). The head unit 23 is disposed in an orientation in which the discharge surface 25A of the print head 25 which is installed on the carriage 24 faces the medium M.

The support stand 42 holds the medium M at a position which is separated by a predetermined distance (a gap) in the discharge direction (in the present example, the vertical direction Z) of the liquid from the discharge surface 25A of the print head 25 when the ink droplets are discharged onto the medium M. The transport unit which is provided in the large format printer 11 includes a plurality of roller pairs (none are illustrated) which transport the medium M which is held by the support stand 42 in the sub-scanning direction Y. The large format printer 11 performs serial printing on the medium M by alternately repeating a printing operation and a transport operation. In the printing operation, the print head 25 discharges ink droplets to perform a single pass (for example, one column) worth of printing onto the medium M through the driving of the transport unit in a process of moving in the main scanning direction X, and in the transport operation, the medium M is transported to the printing position of the next column by the plurality of roller pairs due to the driving of the transport unit. The transport unit may be configured to be provided with a transport belt in addition to or instead of the plurality of roller pairs.

The maximum width (hereinafter referred to as "the maximum printing width") over which the serial printing is possible using the head unit 23 illustrated in FIG. 2 is equal to a support width PW which is a width of the support stand 42 in the main scanning direction X. The support width PW is set to be wider than a standard dimension Ws (the width dimension of the medium of an anticipated maximum standard size) of a medium width W which is the width of the medium M in the main scanning direction X for holding and transporting the medium M in a stable manner. In the present embodiment, the support width PW (that is, the maximum printing width) is less than or equal to 115% of the standard dimension Ws.

In the large format printer 11 of the present embodiment, the maximum width (the maximum printing width) over which the serial printing is possible is 24 inches to 75 inches. For example, the large format printer 11 in which the standard dimension Ws of the medium width W is 24 inches is a printer (referred to as "a 24 inch supporting printer") which supports a maximum printing width of 24 inches, specifically, a printer in which the maximum printing width is greater than 24 inches and less than or equal to 27.6 inches. The large format printer 11 in which the standard dimension Ws of the medium width W is 36 inches is a printer (referred to as "a 36 inch supporting printer") which supports a maximum printing width of 36 inches, specifically, a printer in which the maximum printing width is greater than 36 inches and less than or equal to 41.4 inches. The large format printer 11 in which the standard dimension Ws of the medium width W is 44 inches is a printer (referred to as "a 44 inch supporting printer") which supports a maximum printing width of 44 inches, specifically, a printer in which the maximum printing width is greater than 44 inches and less than or equal to 50.6 inches. The large format printer 11 in which the standard dimension Ws of the medium width W is 64 inches is a printer (referred to as "a 64 inch supporting printer") which supports a maximum printing width of 64 inches, specifically, a printer in which the maximum printing width is greater than 64 inches and less than or equal to 73.6 inches. The configuration is not limited to the maximum printing widths described above and the large format printer 11 may be a large format printer in which a cable 45 is greater than or equal to one meter.

The capping mechanism 43 which seals the discharge surface 25A of the print head 25 is provided at a home position HP which is a starting point of the movement (the reciprocal movement) of the head unit 23. The home position HP is also a position at which the head unit 23 waits when the large format printer 11 is not executing printing.

In the movable region R of the head unit 23, the maintenance mechanism 44 is provided at a location furthest from the home position HP. The maintenance mechanism 44 performs a cleaning process and a wiping process as maintenance processes in a state in which the discharge surface 25A is blocked by a cap (not illustrated). In the cleaning process, ink, bubbles, and the like having increased viscosity inside the nozzles 31 are sucked using a tube pump (not illustrated) through the cap, and in the wiping process, foreign matter such as paper powder which is adhered to the vicinity of the nozzles in the discharge surface 25A is wiped off using a wiper.

The large format printer 11 is provided with a control circuit 50 (a controller) which manages the overall control of the large format printer 11. The control circuit 50 is fixed to a predetermined location inside the main body 14 (refer to FIG. 1). The control circuit 50 of the main body side and the print head 25 are electrically connected to each other via the flexible cable 45. The cable 45 is formed from a flexible flat cable (FFC) for example. The length of the cable 45 which connects the control circuit 50 and the print head 25 to each other is as long as the large format printer 11 in which the maximum width over which serial printing is possible is long. The cable 45 which connects the control circuit 50 and the print head 25 to each other deforms in accordance with the reciprocal movement of the head unit 23 (that is, the print head 25).

The control circuit 50 of the present embodiment is provided with a control substrate 51 and a drive circuit substrate 52. The control substrate 51 and the drive circuit substrate 52 are connected to each other via the cable 45. The cable 45 includes a cable 47 and a cable 48. The cable 47 transmits a plurality of signals which include a power voltage signal VHV (refer to FIG. 4) which serves as an example of a constant voltage signal from the control substrate 51 to the print head 25, and the cable 48 transmits a plurality of signals which include drive signals COMA and COMB (refer to FIG. 4) which serve as examples of drive voltage signals from the drive circuit substrate 52 to the print head 25. A head substrate 60 is installed in the print head 25. The control circuit 50 and the head substrate 60 are connected to each other via the cable 45 (47 and 48).

The drive signals COMA and COMB and print data signals SIn (refer to FIGS. 4 and 5 regarding all of these) which are propagated on the cable 45 from the control circuit 50 are supplied to the head substrate 60. In detail, the print data signals SIn and the power voltage signal VHV which are propagated on the cable 47 from the control substrate 51 are supplied to the head substrate 60 and the drive signals COMA and COMB which are propagated on the cable 48 from the drive circuit substrate 52 are supplied to the head substrate 60. The head substrate 60 drives each of the discharge units 35 (refer to FIG. 2) based on the drive signals COMA and COMB and the print data signal SIn. The print head 25 performs the printing by discharging the liquid (the ink) from each of the nozzles 31 in accordance with variation in the drive signals COMA and COMB which are applied to the drive elements 34 (refer to FIG. 2). The control circuit 50 may be configured by combining the control substrate 51 and the drive circuit substrate 52 into a single substrate. One end of the cable 45 is connected to a terminal on the carriage 24 and the terminal and the head substrate 60 may be connected to each other via a different cable. In summary, any configuration may be adopted as long as the control circuit 50 of the main body side and the print head 25 are connected to each other by the cable 45.

Figure 4:
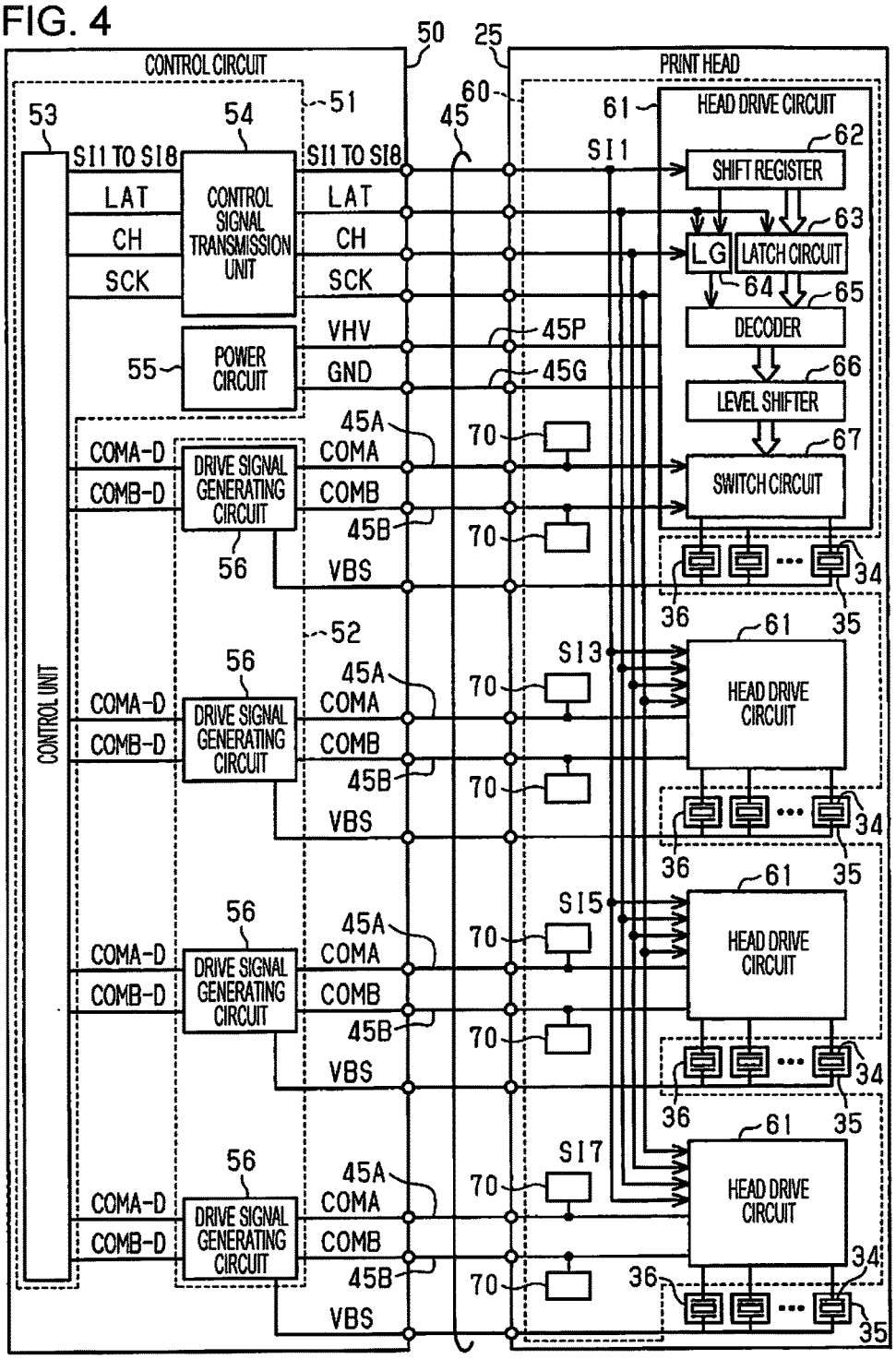
FIG. 4 is a block diagram illustrating the electrical configuration of the large format printer.

FIG. 4 illustrates the electrical configuration of the control system of the print head in the large format printer. As illustrated in FIG. 4, the large format printer 11 is provided with the control circuit 50 print head 25 which are connected to each other via the cable 45 as described earlier. The control circuit 50 includes the control substrate 51 and the drive circuit substrate 52 which are described earlier. A control unit 53, a control signal transmission unit 54, and a power circuit 55 are installed on the control substrate 51. A plurality of (in the example of FIG. 4, four) drive signal generating circuits 56 are installed on the drive circuit substrate 52.

The control unit 53 is realized using a processor such as a micro controller, for example. The control unit 53 generates a plurality of types of control signal which control the discharging of the liquid from the discharge units 35 based on various types of signal such as the image data from the host computer. The control unit 53 generates a plurality of (for example, eight) print data signals SI1 to SI8, a latch signal LAT, a change signal CH, and a clock signal SCK as the control signals and outputs the control signals to the control signal transmission unit 54. The print data signals SI1 to SI8 are control signals which are used in the discharge control of the ink of a plurality of colors (for example, four colors) and the discharge unit groups 36 are the control targets of the print data signals SI1 to SI8, with two of the print data signals SI1 to SI8 for each color. In other words, the print data signal SIn (where n=1, 2, . . . , i and i is the nozzle row number) is generated for every discharge unit group 36.

The control signal transmission unit 54 supplies the plurality of print data signals SI1 to SI8, the latch signal LAT, the change signal CH, and the clock signal SCK which are output from the control unit 53 to the head substrate 60 of the print head 25 via the cable 45. The control signal transmission unit 54 generates a differential signal of a low voltage differential signaling (LVDS) transfer type, for example. Since the amplitude of the differential signal of the LVDS transfer type is approximately 350 mV, it is possible to realize high-speed data transfer. The control signal transmission unit 54 may generate differential signals of various high-speed transfer types other than LVDS such as low voltage positive emitter coupled logic (LVPECL) and current mode logic (CML). A high-speed transfer type which does not use a differential signal may also be adopted.

The power circuit 55 illustrated in FIG. 4 generates the power voltage signal VHV of a constant power voltage (for example, 42 V) which serves as an example of a constant voltage signal and a ground signal GND of a ground voltage (0 V). The power voltage signal VHV is transmitted to the drive signal generating circuits 56 on the drive circuit substrate 52 and is supplied to the circuits including head drive circuits 61 on the head substrate 60 via the cable 45. The ground signal GND is transmitted to the drive signal generating circuits 56 on the drive circuit substrate 52 and is supplied to the circuits including the head drive circuits 61 on the head substrate 60 via the cable 45.

The control unit 53 illustrated in FIG. 4 generates a predetermined number of bits of drive data (waveform data) COMA-D and COMB-D formed from digital data which forms the basis of the drive signals COMA and COMB which drive the discharge units 35 of the print head 25 based on the various signals which are supplied from the host computer. The drive data COMA-D and COMB-D is supplied to each of the drive signal generating circuits 56 on the drive circuit substrate 52.

The drive signal generating circuits 56 illustrated in FIG. 4 generate the drive signals COMA and COMB based on the predetermined number of bits of the drive data COMA-D and COMB-D from the control unit 53. In detail, the drive signal generating circuit 56 generates the drive signal COMA including at least one waveform by subjecting a digital waveform signal which is generated based on the drive data COMA-D to D/A conversion and amplifying the result. In detail, the drive signal generating circuit 56 generates the drive signal COMB including at least one waveform by subjecting a digital waveform signal which is generated based on the drive data COMB-D to D/A conversion and amplifying the result.

A voltage conversion circuit (not illustrated) which converts the power voltage signal VHV from the power circuit 55 to a power voltage signal GVDD of a constant voltage (for example, 7.5 V) and a low power voltage signal VDD of a constant voltage (for example, 3.3 V) is installed on the drive circuit substrate 52. For example, the voltage conversion circuit supplies the power voltage signal VHV to the drive signal generating circuits 56 and supplies the low power voltage signal VDD to the head substrate 60 via the cable 45. Each of the drive signal generating circuits 56 generates a reference voltage signal VBS of a constant voltage (for example, 6 V) from the power voltage signal GVDD which is output from the voltage conversion circuit. The individual drive signal generating circuits 56 differ from each other only in the drive data that is input and the drive signal that is output, have the same circuit configuration, and will be described later in detail.

The drive signals COMA and COMB and the reference voltage signal VBS which are generated by the drive signal generating circuits 56 are supplied to the head substrate 60 via the cable 45. The drive signals COMA which are output from the drive signal generating circuits 56 are all signals of the same waveform and the drive signals COMB are all signals of the same waveform.

The control unit 53 generates the drive data COMA-D and COMB-D according to a temperature signal TH (not illustrated) which is propagated from the print head 25 (the head substrate 60) via the cable 45 such that the waveforms of the drive signals COMA and COMB are corrected. In a case in which an abnormality signal XHOT which is propagated from the print head 25 (the head substrate 60) through the cable 45 is a signal value (for example, a high level) indicating an abnormality, the control unit 53 stops the supplying of the drive data COMA-D and COMB-D to the drive signal generating circuits 56 and stops the discharging of the droplets from the print head 25.

In addition to the processes described above, the control unit 53 controls the movement of the head unit 23 in the main scanning direction X by ascertaining the scanning position (the current position) of the head unit 23 (that is, the carriage 24) and performing drive control on a carriage motor (not illustrated) based on the scanning position of the head unit 23. The control unit 53 controls the movement of the medium M in the sub-scanning direction Y by performing drive control on a transport motor (not illustrated) which is a motive force source of the transport unit. The control unit 53 causes the maintenance mechanism 44 (refer to FIG. 3) to execute a maintenance process (a cleaning process and a wiping process).

As illustrated in FIG. 4, corresponding to the eight discharge unit groups 36, eight (however, only four are illustrated in FIG. 4) of the head drive circuits 61 are installed on the head substrate 60. A control signal reception unit (not illustrated) which differentially amplifies each of the differential signals which are propagated via the cable 45 and converts the results to the print data signals SI1 to SI8, the latch signal LAT, the change signal CH, and the clock signal SCK which are single ended signals is provided on the head substrate 60. The print data signals SI1 to SI8 are supplied to the corresponding head drive circuits 61 and are used in the discharge control of the eight discharge unit groups 36. The latch signal LAT, the change signal CH, and the clock signal SCK are supplied in common to the head drive circuits 61. Overshooting prevention circuits 70 which prevent (remove) overshooting which occurs in the drive signals COMA and COMB in the process of being propagated on the cable 45 at a stage before the input to the head drive circuits 61 are installed on the head substrate 60.

Each of the head drive circuits 61 generates, and outputs to the corresponding discharge unit 35, a drive signal VOUT (refer to FIG. 7) which is provided for every discharge unit 35 which configures the corresponding discharge unit group 36 based on the corresponding one of the print data signals SI1 to SI8 which is input, the latch signal LAT, the change signal CH, the clock signal SCK, and the drive signals COMA and COMB. The drive signal VOUT is applied to one end of the drive element 34 which configures the discharge unit 35 and the reference voltage signal VBS is applied to the other end. Each of the drive elements 34 is displaced according to the potential difference between the drive signal VOUT and the reference voltage signal VBS which are applied to discharge the liquid.

In a configuration in which the control circuit 50 performs discharge control on the i (in the present example, eight) discharge unit groups 36, for example, in a case in which the drive signal is a multi-drive type including j types (in the present example, two types) of the drive signals COMA and COMB, i×j wires inside the cable 45 are used in the transmission of the drive signals COMA and COMB. The overshooting prevention circuit 70 is provided for every one of the i×j wires. The control circuit 50 may be a single drive type in which the discharge control is performed using one type of the drive signal COM, for example, and in this case, i wires inside the cable 45 are used in the transmission of the drive signal COM and the overshooting prevention circuits 70 are provided for every one of the i wires.

Since the circuit configuration of each of the head drive circuits 61 illustrated in FIG. 4 is the same, FIG. 4 illustrates the detailed circuit configuration of only the single head drive circuit 61 to which the print data signal SI1 is input. As illustrated in FIG. 4, the head drive circuit 61 is provided with a shift register 62, a latch circuit 63, a control logic 64, a decoder 65, a level shifter 66, and a switch circuit 67.

Hereinafter, in describing the configuration and the operations of the head drive circuit 61, first, a detailed description will be given of the print data signals SI1 to SI8, the latch signal LAT, the change signal CH, the clock signal SCK, and the drive signals COMA and COMB which are input to the head drive circuit 61 with reference to FIG. 5.

Figure 5:
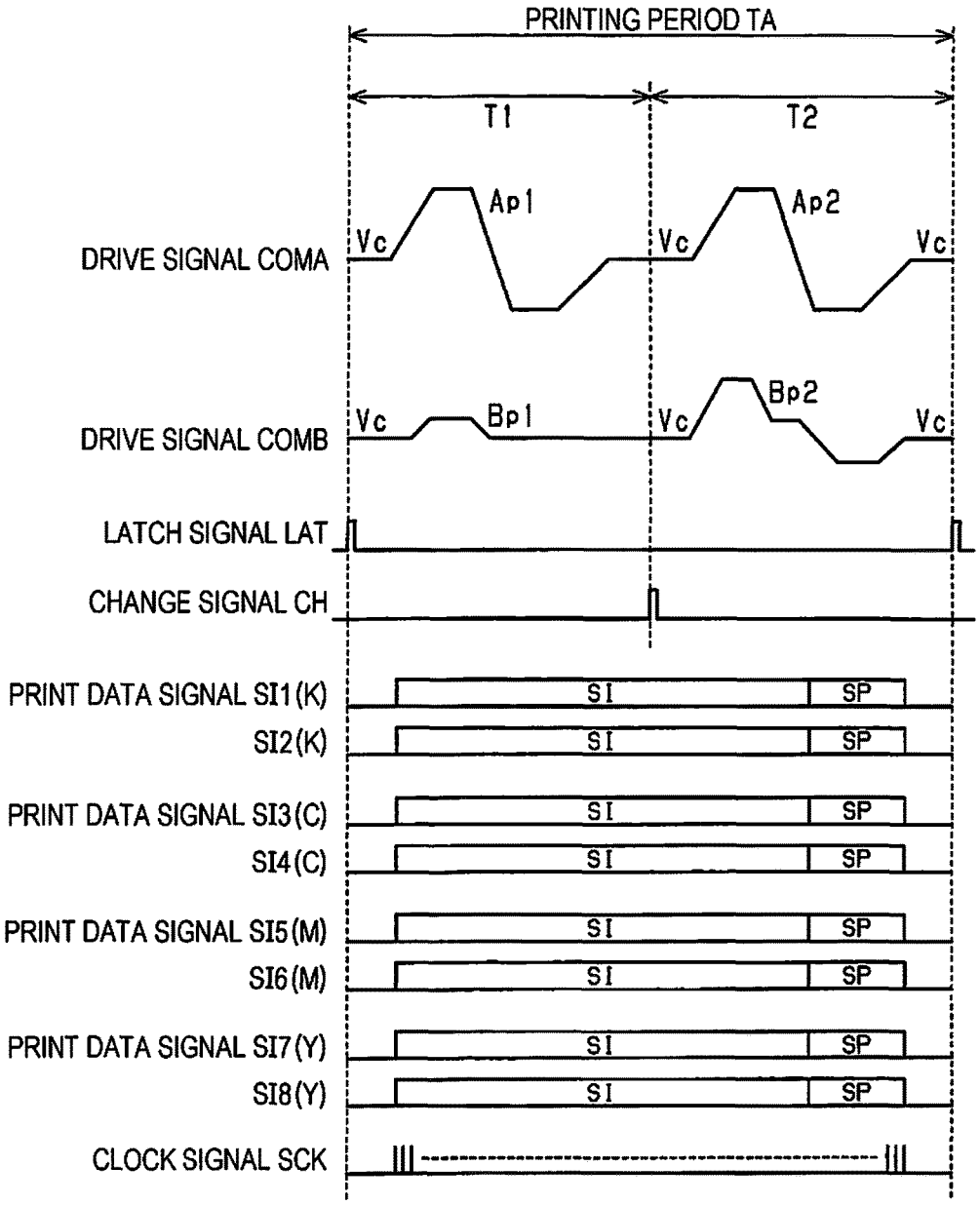
FIG. 5 is a timing chart illustrating drive signals, a latch signal, a change signal, and print data signals.

FIG. 5 illustrates the drive signals COMA and COMB, the print data signals SI1 to SI8, the latch signal LAT, the change signal CH, and the clock signal SCK in a printing period TA which is a discharge period of a droplet for forming one dot (one printed pixel). In the example illustrated in FIG. 5, the printing period TA is divided into a duration T1 from the rise of the latch signal LAT until the rise of the change signal CH and a duration T2 from the rise of the change signal CH until the rise of the next latch signal LAT.

As illustrated in FIG. 5, the drive signal COMA is an analog signal in which a waveform Ap1 (a drive pulse) which is disposed in the duration T1 and a waveform Ap2 (a drive pulse) which is disposed in the duration T2 are consecutive. In the present embodiment, the two waveforms Ap1 and Ap2 are waveforms which are substantially the same as each other. In detail, the waveforms Ap1 and Ap2 are waveforms in which, using a predetermined center potential Vc as a reference, a mountain-shaped trapezoidal waveform (a mountain portion) and a valley-shaped trapezoidal waveform (a valley portion) are consecutive in time series order. In other words, the waveforms Ap1 and Ap2 include a waveform containing the mountain portion and the valley portion in this order.

As illustrated in FIG. 5, the drive signal COMB is an analog signal in which a trapezoidal waveform Bp1 (a drive pulse) which is disposed in the duration T1 and a trapezoidal waveform Bp2 (a drive pulse) which is disposed in the duration T2 are consecutive in time series order. In the present embodiment, the two waveforms Bp1 and Bp2 are waveforms which are different from each other. Of these, the trapezoidal waveform Bp1 is a waveform for suppressing an increase in the viscosity of the ink by subjecting the ink in the vicinity of the opening portion of the nozzle 31 to micro-vibrations. Therefore, even if, hypothetically, the trapezoidal waveform Bp1 is supplied to one end of the drive element 34, the ink droplet is not discharged from the nozzle 31 corresponding to the drive element 34. The waveform Bp2 is a waveform having a different shape from the waveform Ap1 (Ap2), and is a waveform in which the mountain-shaped trapezoidal waveform (the mountain portion) which uses the predetermined center potential Vc as a reference and the valley-shaped trapezoidal waveform (the valley portion) which returns to the center potential Vc are consecutive in time series order. In a case in which the waveform Bp2 is supplied to one end of the drive element 34, it is possible to discharge an ink droplet of a smaller amount than a predetermined amount that is discharged from the nozzle 31 corresponding to the drive element 34 when the waveform Ap1 or Ap2 is supplied to one end of the drive element 34. The voltages at the start timing and the voltages at the end timing of the waveforms Ap1, Ap2, Bp1, and Bp2 are all the center potential Vc in common. In other words, the waveforms Ap1, Ap2, Bp1, and Bp2 are each a waveform that rises from the center potential Vc and returns to the center potential Vc.

Incidentally, other methods exist for the method of forming dots on the medium M in addition to the method (the first method) of discharging an ink droplet one time to form one dot. For example, assuming it is possible to discharge ink droplets two or more times in a unit duration (the printing period TA), there are a method (a second method) of forming a single dot by causing two or more ink droplets which are discharged in a unit duration to land and bonding the two or more landed ink droplets, and a method (a third method) of forming two or more dots without bonding the two or more ink droplets.

In the present embodiment, according to the second method, four-level gradation of "large dot", "medium dot", "small dot", and "non-recording (no dot)" is expressed by discharging the ink a maximum of two times for a single dot. In order to express the four levels of gradation, in the present embodiment, two types of the drive signal COMA and COMB are prepared, and each of the drive signals COMA and COMB holds an early half waveform pattern and a latter half waveform pattern in the single period TA. A configuration is adopted in which, in a single period, the drive signals COMA and COMB in the durations T1 and T2 of the early half and the latter half are selected or not selected according to the gradation to be expressed and the drive signal VOUT which includes a waveform, which is determined by the selection or non-selection of the drive signals COMA and COMB, is supplied to the drive element 34.

As illustrated in FIG. 5, each of the print data signals SI1 to SI8 (SIn) included discharge data SI and definition data SP for waveform selection. In detail, each of the print data signals SI1 to SI8 includes discharge data SI and definition data SP. The discharge data SI contains a number of items of two-bit dot data for causing the discharge unit 35 to form a single pixel (a dot) equal to the number of nozzles (for example, 400) sufficient for one nozzle row, and the definition data SP is for the decoder 65 (FIG. 4) to convert the dot data into the drive signal VOUT which causes the switch circuit 67 to turn on and off. The discharge data SI is configured by high-order bit data SIHn and low-order bit data SILn. In the high-order bit data SIHn, only high-order bits SIH of the dot data (SIH, SIL) which is represented by two bits per single pixel are collected in a number sufficient for the number of nozzles in a single nozzle row, and in the low-order bit data SILn, only low-order bits SIL are collected in a number sufficient for the number of nozzles. The definition data SP is data of a predetermined number of bits (for example, four bits) which defines the correspondence relationship between the two-bit dot data (SIH, SIL) in the discharge data SI and the waveform which is selected from among the waveforms Ap1, Ap2, Bp1, and Bp2 (the drive pulse) in the drive signals COMA and COMB. The clock signal SCK is output in the same output duration as the print data signals SI1 to SI8.

Next, a description will be given of the configuration and the operations of the head drive circuit 61 illustrated in FIG. 4. The print data signals SIn are input to each of the shift registers 62 in the head drive circuits 61. The shift register 62 is provided with a first shift register (first SR), a second shift register (second SR), and a third shift register (third SR) which are not illustrated. The high-order bit data SIHn inside the print data signal SIn is stored in the first SR and the low-order bit data SILn is stored in the second SR. The definition data SP inside the print data signal SIn is stored in the third SR.

The latch circuit 63 illustrated in FIG. 4 receives input of the latch signal LAT, holds the discharge data SI (SIHn, SILn) from the shift register 62 (the first SR and the second SR) based on the latch signal LAT and outputs the discharge data SI which is held until this time at every timing of the printing period TA to the decoder 65.

The change signal CH from the control circuit 50 and the definition data SP from the shift register 62 are input to the control logic 64 illustrated in FIG. 4. The control logic 64 translates the definition data SP and transmits real value table data RD illustrated in FIG. 6 to the decoder 65 at the timing of the change signal CH.

The decoder 65 illustrated in FIG. 4 outputs two-bit selection signals Sa and Sb every duration T1 and T2 with reference to the real value table data RD based on the dot data (SIH, SIL) of a number sufficient for a single nozzle row in the discharge data SI which is input from the latch circuit 63.

Figures 6, 7:
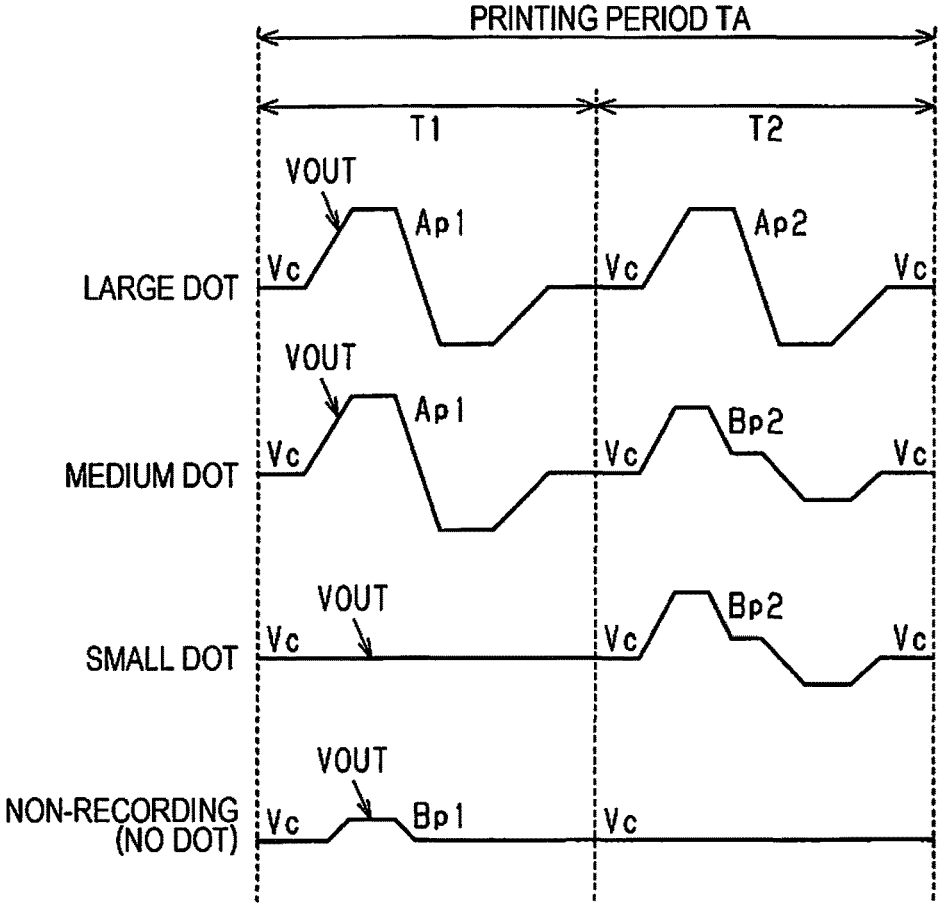
FIG. 6 is a table illustrating decoded content in a decoder.
FIG. 7 is a signal waveform diagram illustrating a relationship between the drive signal that is applied to the drive element and droplet size.

FIG. 6 illustrates the real value table data RD in the decoder 65. The decoder 65 decodes the input two-bit dot data (SIH, SIL) according to the real value table data RD which is defined by the definition data SP and outputs the two-bit selection signals Sa and Sb every duration T1 and T2. If the input dot data (SIH, SIL) is (1, 1) (large dot), for example, the decoder 65 outputs the logical levels of the selection signals Sa and Sb as (H, L) levels in the duration T1 and as (H, L) levels in the duration T2. If the dot data (SIH, SIL) is (1, 0) (medium dot), the decoder 65 outputs the logical levels of the selection signals Sa and Sb as (H, L) levels in the duration T1 and as (L, H) levels in the duration T2. If the dot data (SIH, SIL) is (0, 1) (small dot), the decoder 65 outputs the logical levels of the selection signals Sa and Sb as (L, L) levels in the duration T1 and as (L, H) levels in the duration T2. If the dot data (SIH, SIL) is (0, 0) (non-recording), the decoder 65 outputs the logical levels of the selection signals Sa and Sb as (L, H) levels in the duration T1 and as (L, L) levels in the duration T2. The two-bit selection signals Sa and Sb which the decoder 65 outputs for every duration T1 and T2 are sequentially input to the switch circuit 67 via the level shifter 66.

The level shifter 66 functions as a voltage amplifier and raises the voltage levels of the selection signals Sa and Sb and outputs the results. In a case in which the selection signals Sa and Sb are at the "H" level, the level shifter 66 outputs an electrical signal in which the voltage is raised to approximately several tens of volts (for example, a maximum of approximately 40 V), for example, which is capable of driving the switch circuit 67, and in a case in which the selection signals Sa and Sb are at the "L" level, the level shifter 66 outputs an electrical signal of a L level in a similar manner. In other words, the level shifter 66 level shifts the selection signals Sa and Sb which are input from the decoder 65 to a logical level of a higher amplitude. The selection signals Sa and Sb which are output from the level shifter 66 are input to the switch circuit 67.

The drive signals COMA and COMB which are propagated from the drive signal generating circuit 56 via the cable 45 and the selection signals Sa and Sb which are raised via the level shifter 66 from the decoder 65 are input to the switch circuit 67 illustrated in FIG. 4. Here, of the selection signals Sa and Sb of the duration T1, the selection signal Sa is a signal which defines the selection or the non-selection of a drive pulse Ap1 in the duration T1 in the drive signal COMA illustrated in FIG. 5, and the selection signal Sb is a signal which defines the selection or the non-selection of a drive pulse Bp1 in the duration T1 in the drive signal COMB. Of the selection signals Sa and Sb of the duration T2, the selection signal Sa is a signal which defines the selection or the non-selection of a drive pulse Ap2 in the duration T2 in the drive signal COMA, and the selection signal Sb is a signal which defines the selection or the non-selection of a drive pulse Bp2 in the duration T2 in the drive signal COMB.

Figure 8:
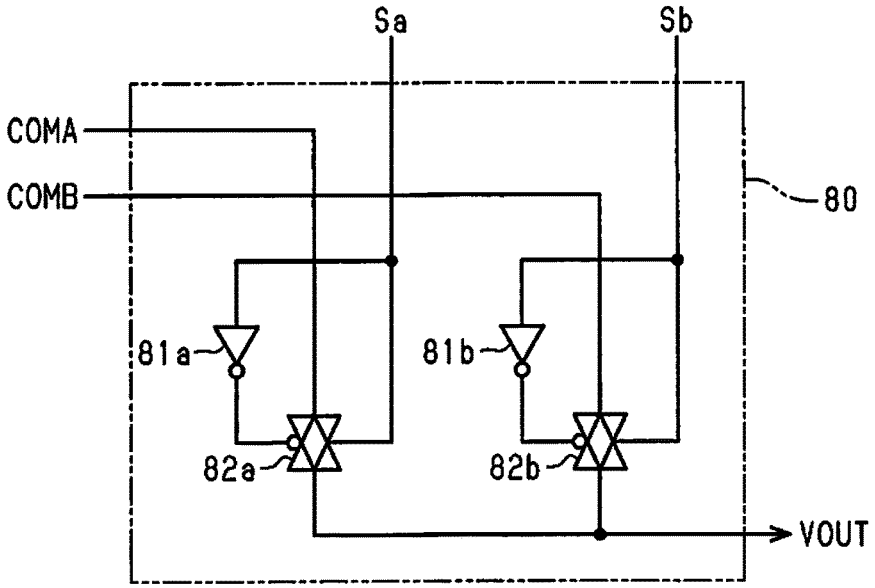
FIG. 8 is a circuit diagram illustrating the configuration of a selection unit.

The switch circuit 67 illustrated in FIG. 4 is provided with a selection unit 80 illustrated in FIG. 8 in the same number (m) as a total number m of the drive elements 34 (that is, the nozzles 31) per single nozzle row. The m selection units 80 select the drive pulses to be applied to the drive elements 34 from the drive signals COMA and COMB for every duration T1 and T2 based on the selection signals Sa and Sb.

FIG. 8 illustrates the configuration of the selection unit 80. As illustrated in FIG. 8, the selection unit 80 includes inverters (NOT circuits) 81*a* and 81*b* and transfer gates 82*a* and 82*b*. While the selection signal Sa from the decoder 65 is supplied to the positive control terminal that does not have a circle mark in the transfer gate 82*a*, the selection signal Sa is logically inverted by the inverter 81*a* and is supplied to the negative control terminal that has a circle mark in the transfer gate 82*a*. In the same manner, while the selection signal Sb is supplied to the positive control terminal of the transfer gate 82*b*, the selection signal Sb is logically inverted by the inverter 81*b* and is supplied to the negative control terminal of the transfer gate 82*b*.

The drive signal COMA is supplied to the input terminal of the transfer gate 82*a* and the drive signal COMB is supplied to the input terminal of the transfer gate 82*b*. The output terminals of the transfer gates 82*a* and 82*b* are connected to each other in common and the drive signal VOUT is output to the discharge unit 35 via the common connection terminal.

The transfer gate 82*a* causes between the input terminal and the output terminal to conduct (turn on) if the selection signal Sa is the H level and causes between the input terminal and the output terminal to not conduct (turn off) if the selection signal Sa is the L level. In the same manner, even for the transfer gate 82*b*, between the input terminal and the output terminal is caused to turn on and off according to the selection signal Sb.

FIG. 7 is a diagram illustrating waveforms of the drive signals VOUT which are output by the selection unit 80. As illustrated in FIG. 6, the selection unit 80 selects the drive pulse Ap1 in the drive signal COMA in the duration T1 and selects the drive pulse Ap2 in the drive signal COMA in the duration T2, and so the drive signal VOUT corresponding to "the large dot" is generated. When the drive signal VOUT is supplied to one end of the drive element 34, approximately a medium amount of the ink is divided into two and discharged from the nozzle 31 during the period TA. Therefore, the droplets of ink land on the medium M and combine with each another to form the large dot.

The selection unit 80 selects the drive pulse Ap1 in the drive signal COMA in the duration T1 and selects the drive pulse Bp2 in the drive signal COMB in the duration T2, and so the drive signal VOUT corresponding to "the medium dot" is generated. When the drive signal VOUT is supplied to one end of the drive element 34, approximately a medium amount and approximately a small amount of the ink is divided into two and discharged from the nozzle 31 during the period TA. Therefore, the droplets of ink land on the medium M and combine with one another to form the medium dot.

In the duration T1, the selection unit 80 does not select either waveform from among the drive signals COMA and COMB and the drive element 34 assumes the voltage Vc from directly prior which is held by the capacitance of the drive element 34, and in the duration T2, the selection unit 80 selects the drive pulse Bp2 in the drive signal COMB, and so the drive signal VOUT corresponding to "the small dot" is generated. When the drive signal VOUT is supplied to one end of the drive element 34, approximately a small amount of the ink is discharged in the duration T2 from the nozzle 31 during the period TA. Therefore, the droplet of ink lands on the medium M to form the small dot.

The selection unit 80 selects the drive pulse Bp1 which is a trapezoidal waveform inside the drive signal COMB in the duration T1, and in the duration T2, the selection unit 80 does not select either waveform from among the drive signals COMA and COMB and the drive element 34 assumes the voltage Vc from directly prior which is held by the capacitance of the drive element 34, and so the drive signal VOUT corresponding to "non-recording" is generated. When the drive signal VOUT is supplied to one end of the drive element 34, the nozzle 31 only performs micro-vibrations in the duration T1 during the printing period TA and the ink is not discharged. Therefore, the ink does not land on the medium M and the dot is not formed.

The large format printer 11 of the present embodiment is designed in anticipation of printing greater than or equal to a defined number of sheets (for example, two sheets) every minute of printed matter of A3 short side width size (for example, A3 pages) at a defined printing resolution (for example 5760×1440 dpi) using 400 or 800 drive elements 34 per single color. In order to satisfy the printing conditions, the discharge units 35 of the print head 25 are capable of discharging the liquid at a frequency greater than or equal to 30 kHz to perform the printing.

In the present embodiment, the drive signal generating circuit 56 generates a digital waveform signal based on the drive data (the waveform data) COMA-D and COMB-D which are the digital signals that are input. The drive signal generating circuit 56 is provided with a digital amplifier (not illustrated) which outputs the drive signals COMA and COMB by converting the digital waveform signals into analog signals and amplifying the result. The digital amplifier is provided with a digital analog converter (DAC) and an amplifying circuit (both not illustrated), for example.

Incidentally, when the drive data COMA-D and COMB-D are subjected to frequency spectral analysis, there is a peak at approximately 60 kHz, for example, and frequencies of approximately 10 kHz to 400 kHz are included. Here, it is necessary that the drive signals COMA and COMB substantially faithfully reproduce the waveforms of the drive data COMA-D and COMB-D while suppressing jaggies. In order to amplify the drive signals COMA and COMB using the digital amplifier, it is necessary to drive the digital amplifier at a switching frequency greater than or equal to ten times that of the frequency component that is included in the pre-amplification drive signal at a minimum. Since most components are less than 100 kHz, it is desirable to use a digital amplifier capable of being driven at a switching frequency of approximately 1 MHz at a minimum, which is ten times 100 kHz, for the DAC of the drive signal generating circuit 56. When the power voltage VHV is set to 42 V, for example, it is necessary for the amplitude of the drive signal COM to be a wide range of approximately 2 V to 37 V. In order to secure the waveform quality and perform the pulse modulation, there is a demand for driving using a modulated signal of a megahertz-order high frequency. Therefore, in the present embodiment, a pulse density modulation type DAC that is suitable for high-frequency driving is adopted rather than the pulse width modulation type. The DAC is not limited to the pulse density modulation type and may be any modulation type that can handle megahertz-order high-frequency driving.

Figure 9:
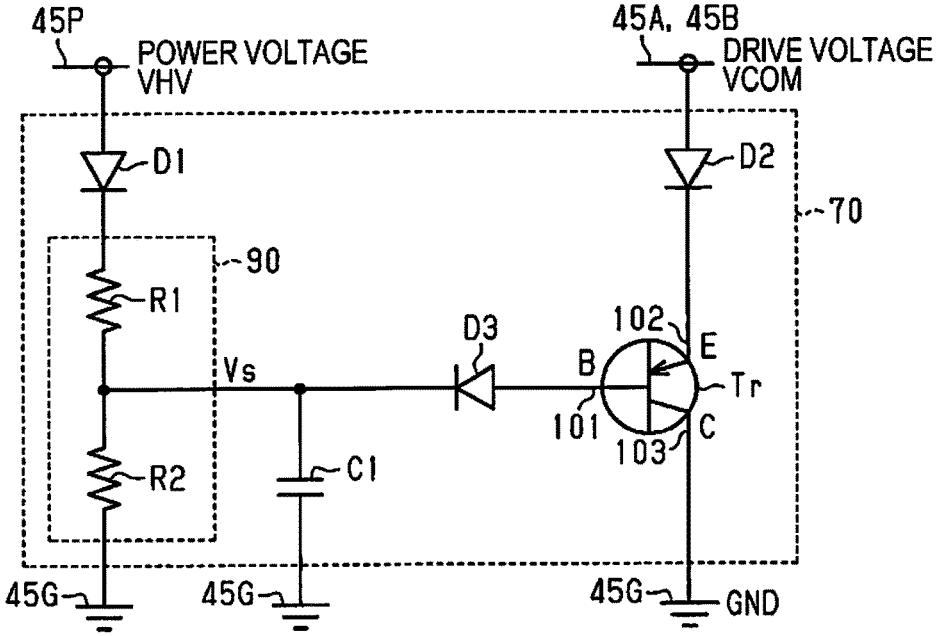
FIG. 9 is a circuit diagram illustrating an overshooting prevention circuit.

Next, a description will be given of the configuration of the overshooting prevention circuit 70 with reference to FIG. 9. The overshooting prevention circuit 70 is connected to a power line 45P and signal lines 45A and 45B illustrated in FIG. 4, and is grounded to a ground line 45G. The overshooting prevention circuit 70 receives the input of the power voltage VHV from the power line 45P and the drive signal COM from the signal line 45A or 45B illustrated in FIG. 4. In FIG. 9, the drive signals COMA and COMB are not particularly distinguished and will be denoted as the drive signal COM, and the voltage thereof will be denoted as the drive voltage VCOM.

As illustrated in FIG. 9, the overshooting prevention circuit 70 is provided with a voltage dividing circuit 90, a transistor Tr, three diodes D1 to D3, and a capacitor C1. The first diode D1 and the voltage dividing circuit 90 are connected in series between the power line 45P and the ground line 45G. The anode terminal of the first diode D1 is connected to the power line 45P and the cathode terminal of the first diode D1 is connected to the voltage dividing circuit 90. The first diode D1 allows a current flowing from the power voltage VHV toward ground and prevents a current flowing in the opposite direction. The voltage dividing circuit 90 is provided with a first resistance R1 and a second resistance R2 which are connected in series. The voltage dividing circuit 90 subjects the power voltage VHV to voltage division using the first resistance R1 and the second resistance R2 and generates a reference voltage Vs which serves as an example of a voltage-divided voltage signal.

The transistor Tr includes three terminals of a first terminal 101, a second terminal 102, and a third terminal 103. The transistor Tr is a bipolar transistor, for example, and the first terminal 101 is a base terminal B, the second terminal 102 is an emitter terminal E, and the third terminal 103 is a collector terminal C.

Meanwhile, the second diode D2 and the transistor Tr are connected in series between the signal line 45A or 45B and the ground. The second diode D2 allows a current flowing from the drive voltage VCOM toward ground GND and prevents a current flowing in the opposite direction. The anode terminal of the second diode D2 is connected to the signal line 45A or 45B and the cathode terminal of the second diode D2 is connected to the second terminal 102 of the transistor Tr.

As illustrated in FIG. 9, the space between the resistances R1 and R2 which configure the voltage dividing circuit 90 and the first terminal 101 of the transistor Tr are connected via the third diode D3. The third diode D3 is provided in an orientation that allows a current flowing from the second terminal 102 toward a node between the resistances R1 and R2 and prevents a current flowing in the opposite direction. The anode terminal of the third diode D3 is connected to the second terminal 102 of the transistor Tr and the cathode terminal of the third diode D3 is connected between the resistances R1 and R2. The capacitor C1 is connected between the wiring, which connects the space between the resistances R1 and R2 to the third diode D3, and the ground line 45G. The capacitor C1 includes a function of stabilizing the reference voltage Vs. The reference voltage Vs is input to the first terminal 101 (the base terminal B) of the transistor Tr and is a voltage for causing the transistor Tr to operate. In other words, the transistor Tr turns on when the drive voltage VCOM of the drive signals COMA and COMB exceeds the reference voltage Vs and turns off when the drive voltage VCOM is less than or equal to the reference voltage Vs. When the transistor Tr turns on, a current flows between the second terminal 102 and the third terminal 103 (the emitter E to the collector C) and the drive voltage VCOM is lowered.

When overshooting in which the drive voltage VCOM is higher than the power voltage VHV occurs (VCOM>VHV), the first diode D1 prevents a current from flowing backward inside the overshooting prevention circuit 70 from the drive voltage VCOM toward the power voltage VHV. During ordinary operation in which the drive voltage VCOM is lower than the power voltage VHV occurs (VCOM<VHV), the second diode D2 prevents a current from flowing backward inside the overshooting prevention circuit 70 from the power voltage VHV toward the drive voltage VCOM. The third diode D3 prevents a base voltage VB of the transistor Tr from becoming excessively higher than the emitter voltage VE.

Figure 10:
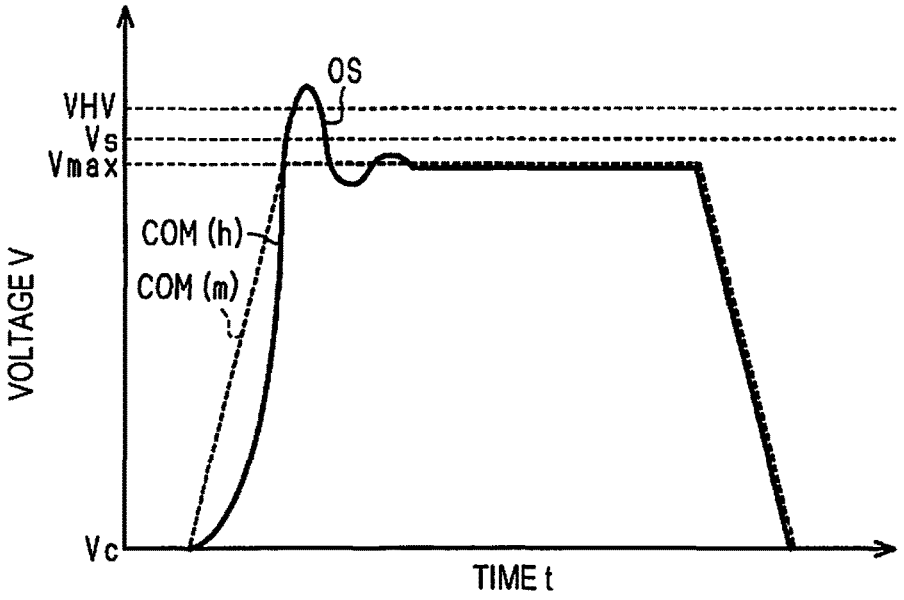
FIG. 10 is a waveform graph describing a setting of a reference voltage.
Figure 11:
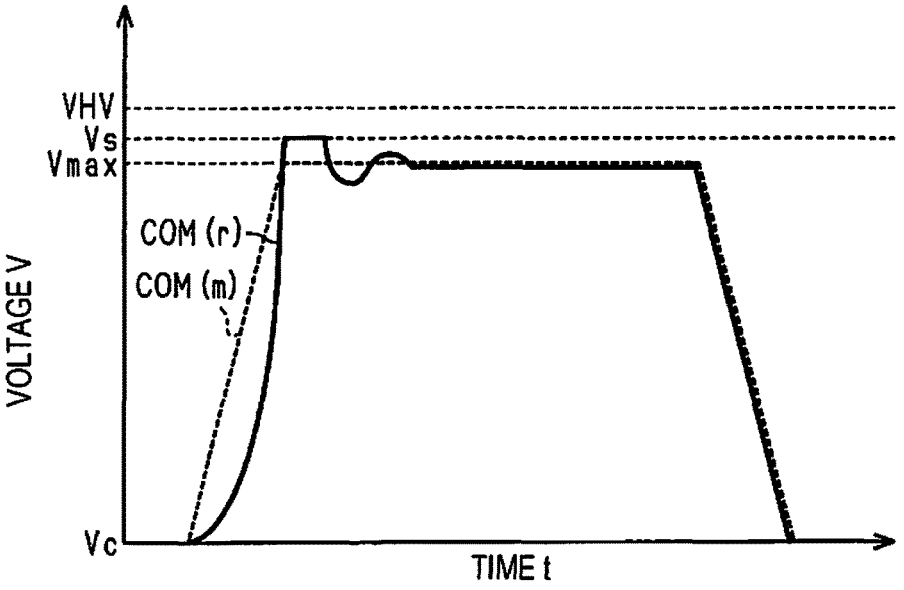
FIG. 11 is a waveform graph illustrating a drive signal in which overshooting is suppressed.

Next, a description will be given of the transition of the waveform of the drive signal COM with reference to FIGS. 10 and 11. FIG. 10 illustrates a digital drive signal COM (m) from before being generated by the drive signal generating circuit 56 and input to the cable 45 and a drive signal COM (h) from when the drive signal is propagated on the flexible cable 45 and input to the print head 25. In the example of FIG. 10, only a portion of the positive trapezoidal waveform is illustrated from among the waveforms (the drive pulses) which are included in the drive signal COM which does not particularly distinguish the drive signals COMA and COMB.

The power voltage VHV is set to a value which is less than the rated voltage of the electronic components having the lowest rated voltage (for example, the transfer gates 82*a*, 82*b*, and the like) from among the various electronic components to which the drive signals COMA and COMB are applied in the head drive circuit 61. The maximum potential of the drive signal COM is set to a lower value than the power voltage VHV. Incidentally, when the drive signal COM is a trapezoidal waveform, at the corner portion of the waveform at which the potential variation amount per unit time is greatest, overshooting occurs easily due to an induced current which is generated in preventing a variation in potential (current) caused by an electromagnetic induction effect. The more the number of nozzles of the print head 25 increases and the number of the discharge units 35 (that is, the nozzles 31) which are supported per single wire in the cable 45, the relatively greater the power of the drive signal COM per single wire becomes and detrimental influence during the occurrence of overshooting easily increases.

As illustrated in FIGS. 5 and 10, in particular, in the present example, since it is necessary to link the timing of the operation of the piezoelectric element, which is used as the drive element 34, to the behavior of a meniscus, there is to be fine detail in the waveform design. For example, the time (the length of the top side of the trapezoidal waveform in FIGS. 5 and 10) during which to hold the maximum potential of the waveform is set to a Helmholtz frequency of 1/N (for example, a value in the range of 1/2 to 1/10). Since it is necessary to strictly perform the setting of the hold time, it is necessary to strictly perform waveform formation control of a corner portion of the waveform. Since the time variation in the frequency at the corner portion which includes a high-frequency component is relatively great, as illustrated in FIG. 10, overshooting occurs easily at the corner portion of the waveform in the drive signal COM in comparison to the other portions of the waveform.

The longer the long flexible cable 45 which can support serial printing greater than or equal to A3 short side and is greater than or equal to 1 m, the greater the inductance of the flexible cable 45, when the flexible cable 45 moves or slides, the variation width of the inductance increases and overshooting that exceeds a rating occurs easily. When overshooting OS exceeds the power voltage VHV, an excessive voltage which exceeds the rated voltage is applied to the transfer gates 82*a* and 82*b* and the drive elements 34.

As illustrated in FIG. 10, in the present embodiment, the reference voltage Vs which is input to the first terminal 101 of the transistor Tr is set to a value between a maximum potential Vmax of the drive signal COM and the power voltage VHV. Here, the maximum potential Vmax indicates the maximum potential of the waveform having the highest maximum potential among the maximum potentials of a plurality of waveforms which are included in the drive signal COM. Therefore, when the drive voltage VCOM exceeds the reference voltage Vs due to the occurrence of the overshooting OS, since the transistor Tr inside the overshooting prevention circuit 70 turns on, as illustrated in FIG. 11, a drive signal COM (r) in which the portions exceeding the reference voltage Vs in the overshooting OS are removed is obtained.

Next, a description will be given of the operations of the large format printer 11. When the large format printer 11 receives print data from a host computer and receives a print execution instruction, for example, the large format printer 11 starts the printing control.

The drive signal generating circuit 56 generates the drive signals COMA and COMB (dashed lines in FIG. 10) based on the drive data COMA-D and COMB-D from the control unit 53. The drive signals COMA and COMB which are generated are propagated via the flexible cable 45 to the head substrate 60 inside the print head 25. In the process of being propagated on the long flexible cable 45 of greater than or equal to 1 m, the overshooting OS (FIG. 10) occurs in the drive signals COMA and COMB due to the large inductance, an electromagnetic inductance effect, and the like, and a drive signal COM (h) in which the overshooting OS occurs is input to the head substrate 60 of the print head 25.

In the head substrate 60, the power voltage VHV is input to the overshooting prevention circuit 70 from the power line 45P and the drive signal COM (COMA or COMB) is input from the signal line 45A or 45B. The reference voltage Vs is input to the first terminal 101 (the base terminal B) of the transistor Tr as a voltage-divided voltage signal which is obtained by subjecting the power voltage VHV to voltage division using the resistances R1 and R2 of the voltage dividing circuit 90. The drive voltage VCOM is input to the second terminal 102 (the emitter terminal E) of the transistor Tr.

For example, when the overshooting OS which exceeds the reference voltage Vs occurs in the drive signal COM, the drive signal COM (h) (the solid line in FIG. 10) in which the overshooting OS occurs exceeds the reference voltage Vs and the transistor Tr turns on. As a result, a current flows between the second terminal 102 and the third terminal 103 (the emitter terminal E to the collector terminal C) of the transistor Tr in FIG. 9. The transistor Tr remains on until the drive signal COM (h) becomes less than the reference voltage Vs. As a result, from the drive signal COM (h) (refer to FIG. 10) which has the overshooting OS, the drive signal COM (r) (refer to FIG. 11) in which the overshooting OS which exceeds the reference voltage Vs is removed is obtained.

When the drive signal COM becomes less than or equal to the reference voltage Vs, the transistor Tr turns on. In this manner, the drive signal COM (r) in which the overshooting OS is removed and which is illustrated by the solid line in FIG. 11 is input to the head drive circuit 61. However, although the portions which do not exceed the reference voltage Vs in the overshooting OS are not removed, since the potential of these portions is less than the rated voltage, a voltage which exceeds the rating will not be applied to the transfer gates 82*a* and 82*b* and the drive element 34. Since the overshooting prevention circuit 70 is disposed for every pair of the signal lines 45A and 45B (refer to FIG. 4) on which the drive signals COMA and COMB are propagated, a voltage exceeding the rating is prevented from being applied to the transfer gates 82*a*, 82*b*, and the drive element 34 which are provided for every nozzle row 32 of the plurality of head drive circuits 61. As a result, it is possible to protect the transfer gates 82*a* and 82*b* from damage originating in this type of overshooting OS and caused by a voltage exceeding the rating being applied. Even in a single drive type in which the control circuit 50 controls the discharging of i nozzle rows 32 using one type of the drive signal COM, for example, the drive signal COM is capable of protecting the transfer gates 82*a*, 82*b*, and the like using the overshooting prevention circuit 70 for every i wires inside the cable 45.

When the overshooting occurs (VCOM>VHV), backward flowing of a current from the drive voltage VCOM to the power voltage VHV is prevented in the overshooting prevention circuit 70 by the first diode D1. During ordinary operation when the overshooting does not occur (VCOM<VHV), backward flowing of a current from the power voltage VHV to the drive voltage VCOM is prevented in the overshooting prevention circuit 70 by the second diode D2. The base voltage of the transistor Tr is prevented from becoming excessively higher than the emitter voltage by the third diode D3. Therefore, it is possible to protect the transistor Tr.

According to the first embodiment which is described in detail above, it is possible to obtain the following effects.

(1) The large format printer 11 which performs serial printing on the medium M which is greater than or equal to A3 short side width is provided with the print head 25 which discharges the liquid (the ink) in accordance with variation in the drive signals COMA and COMB which are applied to the drive element 34, and the control circuit 50 which generates the drive signals COMA and COMB. The large format printer 11 includes the cable 45 which is greater than or equal to 1 m which transmits the power voltage signal VHV which serves as an example of the constant voltage signal for driving the print head 25, the and the drive signals COMA and COMB which serve as examples of the drive voltage signal from the control circuit 50 to the print head 25. The overshooting prevention circuits 70 which render the voltages of the drive signals COMA and COMB which are applied to the drive elements 34 less than or equal to the voltage of the power voltage signal VHV are disposed in the print head 25. Therefore, the overshooting prevention circuits 70 render the voltages of the drive signals COMA and COMB which are applied to the drive elements 34 less than or equal to the voltage of the power voltage signal VHV. As a result, it is possible to suppress the overshooting which occurs in the process of the drive voltage signal being propagated on the cable. Therefore, it is possible to suppress the voltage of the drive signal COMA to less than or equal to the voltage of the voltage-divided voltage signal which is obtained by subjecting the voltage of the constant voltage signal (a constant voltage) to voltage division. Accordingly, it is possible to effectively reduce the overshooting.

(2) The overshooting prevention circuit 70 includes a voltage dividing circuit which receives input of the power voltage signal VHV, performs voltage division, and outputs the reference voltage Vs which serves as an example of the voltage-divided voltage signal of a voltage which is less than or equal to the voltage of the power voltage signal VHV.

It is preferable to render the voltage of the drive voltage signal which is applied to the drive element less than or equal to the voltage of the voltage-divided voltage signal.

In this configuration, it is possible to suppress the voltage of the drive voltage signal to less than or equal to the voltage of the voltage-divided voltage signal which is obtained by subjecting the voltage of the constant voltage signal (a constant voltage) to voltage division. Accordingly, it is possible to effectively reduce the overshooting.

(3) The first diode D1 for preventing a current from flowing backward is disposed at the terminal to which the power voltage VHV is input in the overshooting prevention circuit 70. Accordingly, it is possible to prevent a current from flowing backward in the overshooting prevention circuit 70 when the overshooting occurs (the voltage VCOM of the drive signal>the power voltage VHV).

(4) The second diode D2 for preventing a current from flowing backward is disposed at the terminal to which the drive signals COMA and COMB are input in the overshooting prevention circuit 70. Accordingly, it is possible to prevent a current from flowing backward in the overshooting prevention circuit 70 during ordinary operation when the overshooting does not occur (the voltage VCOM of the drive signal≤the power voltage VHV) using the second diode D2.

(5) The third diode D3 for protection is disposed at the first terminal 101 to which the reference voltage Vs (the voltage-divided voltage signal) is input from the voltage dividing circuit 90. Therefore, it is possible to prevent the input voltage of the first terminal 101 from becoming excessively higher than the input voltage (the voltage VCOM of the drive signal) of the second terminal 102. Accordingly, it is possible to protect the transistor Tr using the third diode D3.

(6) In the large format printer 11, the maximum width over with the serial printing is possible is 24 inches to 75 inches. Accordingly, even if the cable 45 is long to the extent that the serial printing is possible at the maximum width of 24 inches to 75 inches, it is possible to more effectively suppress the occurrence of the overshooting OS in the process of the drive signals COMA and COMB being propagated on the cable 45 using the overshooting prevention circuit 70.

(7) In the large format printer 11, the maximum width over which the serial printing is possible corresponds to one of 24 inches, 36 inches, 44 inches, and 64 inches. Accordingly, even if the cable 45 is a comparatively long cable which supports the serial printing of any one of 24 inches, 36 inches, 44 inches, and 64 inches, it is possible to effectively suppress the occurrence of the overshooting OS in the drive signals COMA and COMB in the process of the drive signals COMA and COMB being propagated on the cable 45.

(8) The print head 25 discharges the liquid at a frequency greater than or equal to 30 kHz. The drive signals COMA and COMB which are propagated on the cable 45 to drive the print head 25 are high-frequency signals of a still greater value than 30 kHz. Therefore, although the overshooting occurs easily in the process of the drive signals COMA and COMB being propagated on the cable 45, it is possible to effectively remove the overshooting OS using the overshooting prevention circuit 70.

The embodiment may also be modified to the forms described below.

Figure 12:
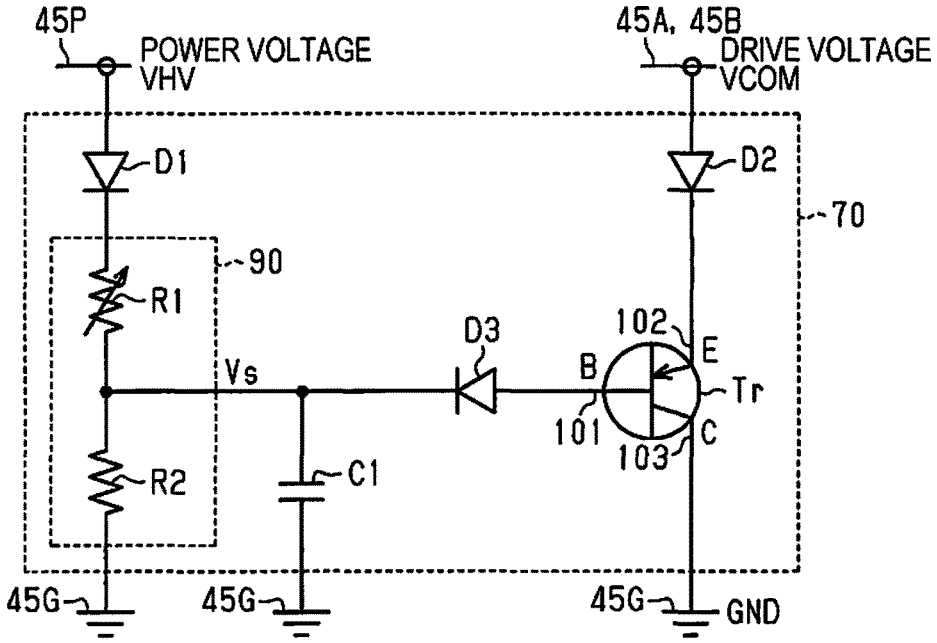
FIG. 12 is a circuit diagram illustrating an overshooting prevention circuit in a modification example.
Figure 13:
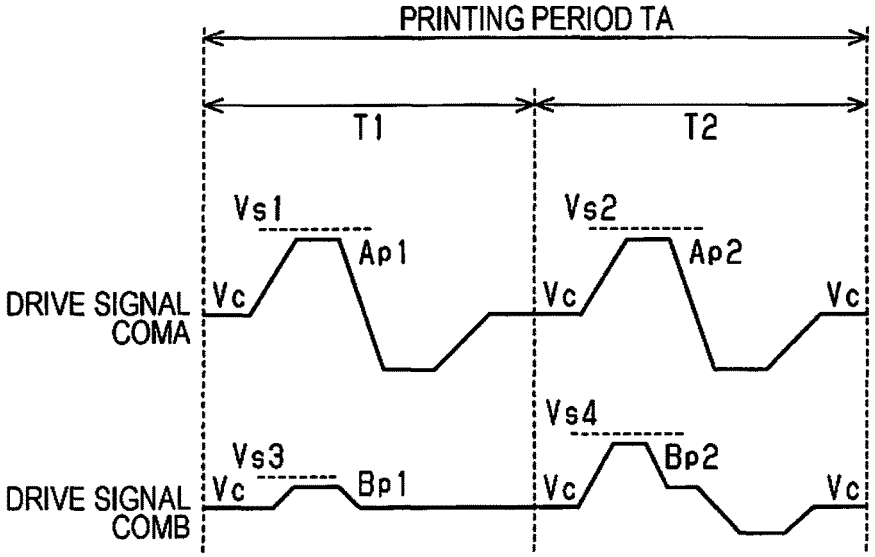
FIG. 13 is a waveform graph describing a setting method of a reference voltage.

In the embodiment, as illustrated in FIG. 12, for example, at least one of the first resistance R1 and the second resistance R2 is set to a variable resistance and the voltage dividing circuit 90 may be configured such that the voltage value of the voltage-divided voltage signal is variable. The voltage dividing circuit 90 may change the reference voltage Vs which serves as an example of the voltage-divided voltage signal to a value corresponding to a waveform (for example, a value corresponding to a maximum value of a waveform) for every one of a plurality of waveforms (drive pulses) included in the drive signals COMA and COMB. For example, a reference table illustrating a correspondence relationship between the definition data SP in the print data signal SIn which is received by the head drive circuit 61 and reference voltages Vs1 to Vs4 corresponding to the maximum values for every waveform in the drive signal COM is stored in the memory of the print head 25. When the head drive circuit 61 acquires the definition data SP, the head drive circuit 61 refers to the reference table which is read out from the memory and acquires the reference voltages Vs1 to Vs4 for every one of the waveforms in the drive signal COM illustrated in FIG. 13 or resistance values r1 to r4 of a variable resistance R11 which is capable of setting the reference voltages Vs1 to Vs4. The head drive circuit 61 sequentially sets the variable resistance R11 of the overshooting prevention circuit 70 the reference voltages Vs1 to Vs4 corresponding to the maximum value (the hold voltage) of the waveform in the duration for every timing (for example, for every one of the durations T1 and T2) of each waveform. For example, in the overshooting prevention circuit 70 which is connected to the signal line 45A, the variable resistance R11 is sequentially switched to the resistance values r1 and r2 in the durations T1 and T2 in FIG. 13, and in the overshooting prevention circuit 70 which is connected to the signal line 45B, the variable resistance R11 is sequentially switched to the resistance values r3 and r4 in the durations T1 and T2 in FIG. 13. As a result, for every waveform in the drive signals COMA and COMB, the reference voltages Vs1 to Vs4 which are slightly greater than the maximum value corresponding to the maximum value of the respective waveform are set. In this manner, if the variable voltage dividing circuit 90 in which the reference voltage Vs is variable is adopted, it is possible to appropriately suppress the overshooting for every waveform of the drive signals COMA and COMB.

There is a case in which the maximum voltages for every waveform (drive pulse) included in the drive signals COMA and COMB are irregular for every print head 25 originating in manufacturing irregularities in the print head 25. Therefore, the reference voltages Vs1 to Vs4 corresponding to the maximum voltages for every one of a plurality of (for example, four) waveforms are individually set for every print head 25 (that is, for every large format printer 11). The single reference voltage Vs for every print head 25 or the plurality of reference voltages Vs1 to VS4 for every waveform are set individually. In this case, regardless of the manufacturing irregularities in the print head 25, it is possible to suitably suppress the overshooting of the drive signals COMA and COMB. In the example illustrated in FIG. 12, of the first resistance R1 and the second resistance R2 in the embodiment (FIG. 9), only the first resistance R1 is set to be the variable resistance R11. However, configurations may be adopted in which only the other resistance R2 is set to be a variable resistance and in which both of the two resistances R1 and R2 are set to be variable resistances.

The large format printer 11 may be prepared with a plurality of discharge modes having different waveform content of the drive signal COM, and the head drive circuit 61 ascertains the current discharge mode from among the plurality of discharge modes based on the definition data SP, for example, which is included in the print data signal SIn. The head drive circuit 61 sets the single reference voltage Vs or the plurality of reference voltages Vs1 to Vs4 for every waveform according to the discharge mode by changing the resistance value of the variable resistance R11 according to the ascertained discharge mode. In this configuration, even if the discharge mode is changed, it is possible to suitably remove the overshooting OS from the drive signal COM.

The cable is not limited to the flexible flat cable and may be a flexible cable. For example, the cable may be a coaxial cable or a tubular multi-core cable. The control circuit 50 and the print head 25 may be connected to each other via a plurality of flexible cables. The cable may be configured to include at least one signal line. Although a plurality of the cables including a single signal line may be bundled, it is preferable to use a cable including a plurality of signal lines with the object of reducing the number of cables to connect between the control circuit 50 and the print head 25.

The transistor may be a Darlington transistor in which two transistors are connected to each other.

The third terminal of the transistor may be connected to ground via a resistance. In summary, the third terminal may be connected directly or indirectly to ground such that conduction from the second terminal to the third terminal is possible when the transistor is turned on.

The transistor Tr is not limited to a bipolar transistor. The transistor Tr may be a unipolar transistor such as a field effect transistor (FET), for example. In a case in which the transistor Tr is a field effect transistor, the first terminal 101 corresponds to the gate terminal G, the second terminal 102 corresponds to the drain terminal D, and the third terminal 103 corresponds to the source terminal S.

The medium M is not limited to a long medium which is fed out from the roll body 16 and may be a sheet type medium such as single sheet paper having a width greater than or equal to A3 short side width.

The control circuit 50 may be realized through the cooperation of software of a computer which executes a program and hardware of an electronic circuit such as an application specific IC (ASIC), may be realized by only software, and further, may be realized by only hardware.

The large format printer may be a textile printing apparatus, for example, as long as the large format printer is a serial scan type ink jet printer which discharges a liquid in accordance with variation in a drive voltage signal which is applied to a drive element. The large format printer is not limited to an ink jet printer, and may be a printer which is provided with a print head which prints in accordance with variations in a drive voltage signal which is applied to a drive element, and, for example, may be a dot impact printer and may be a heat transfer type printer.

The large format printer is not limited to a printing apparatus which discharges an ink onto a medium such as paper or film to print an image, and may be an industrial large format printer which uses printing technology (ink jet technology) to discharge a liquid and is used in the manufacturing of electronic components. For example, an industrial large format printer which discharges a liquid other than ink (including a liquid, a liquid-state body in which particles of a functional material are dispersed or mixed in a liquid, and a fluid-state body such as a gel). For example, a liquid discharging apparatus which discharges a liquid body which contains a material such as an electrode material or a color material (pixel material) in the form of a dispersion or a solution may be used as this type of industrial large format printer. The electrode material or the color material may be used in the manufacture or the like of liquid crystal displays, electro-luminescence (EL) displays, and surface emission displays. The industrial large format printer may also be a liquid discharging apparatus which discharges biological organic matter used in the manufacture of bio-chips or a liquid discharging apparatus which is used as a precision pipette to eject a liquid which serves as a sample. A liquid discharging apparatus which discharges lubricant at pinpoint precision into precision machines such as clocks and cameras, a liquid discharging apparatus which discharges a transparent resin liquid such as ultraviolet curing resin onto a substrate in order to form minute semispherical lenses (optical lenses) and the like used in optical communication elements and the like, or a liquid discharging apparatus which discharges an acidic, alkaline, or the like etching liquid for etching a substrate or the like, may also be used as the industrial large format printing apparatus. The large format printer may be a three-dimensional ink jet printer (liquid discharging apparatus) which discharges a liquid such as a resin liquid to manufacture three-dimensional structures.

Examples of the large format printer which perform the serial printing are not limited to a serial scanning type and include a lateral scanning type in which the print head (the carriage) is capable of movement in the two directions of the main scanning direction X and the sub-scanning direction Y. In summary, it is sufficient for the large format printer to be configured such that the print head and the control circuit are connected to each other by a cable in order for it to be possible for the print head to move in the main scanning direction and perform printing and to enable the movement of the print head in the main scanning direction.

What is claimed is:

1. A large format printer capable of serial printing on a medium which is greater than or equal to A3 short side width comprising:

a print head which performs printing in accordance with variations in a drive voltage signal which is applied to a drive element;

a control circuit which generates the drive voltage signal; and a cable which is greater than or equal to 1 m and transmits a constant voltage signal and the drive voltage signal for driving the print head from the control circuit to the print head, wherein an overshooting prevention circuit which renders a voltage of the drive voltage signal which is applied to the drive element less than or equal to a voltage of the constant voltage signal is disposed in the print head.

2. The large format printer according to claim 1, wherein the overshooting prevention circuit includes a voltage dividing circuit which receives an input of the constant voltage signal, subjects the voltage of the constant voltage signal to voltage division, and outputs a voltage-divided voltage signal of a voltage which is less than or equal to the voltage of the constant voltage signal, and wherein the overshooting prevention circuit renders the voltage of the drive voltage signal which is applied to the drive element less than or equal to the voltage of the voltage-divided voltage signal.

3. The large format printer according to claim 2, further comprising:

a transistor including terminals to which the voltage-divided voltage signal and the drive voltage signal are input respectively, wherein a third diode for protection is disposed at a terminal to which the voltage-divided voltage signal is input in the transistor.

4. The large format printer according to claim 2, wherein the voltage dividing circuit is configured such that the voltage of the voltage-divided voltage signal is variable.

5. The large format printer according to claim 4,
wherein the drive voltage signal includes a plurality of waveforms, and
wherein the voltage dividing circuit changes a voltage value of the voltage-divided voltage signal to a value corresponding to a waveform for every one of the waveforms of the drive voltage signal.

6. The large format printer according to claim 1,
wherein a first diode for preventing a current from flowing backward is disposed at a terminal to which the constant voltage signal is input in the overshooting prevention circuit.

7. The large format printer according to claim 1,
wherein a second diode for preventing a current from flowing backward is disposed at a terminal to which the drive voltage signal is input in the overshooting prevention circuit.

8. The large format printer according to claim 1,
wherein a maximum width over which the serial printing is possible is 24 inches to 75 inches.

9. The large format printer according to claim 8,
wherein the maximum width over which the serial printing is possible is any one of 24 inches, 36 inches, 44 inches, and 64 inches.

10. The large format printer according to claim 1,
wherein the print head discharges a liquid at a frequency greater than or equal to 30 kHz to perform printing.

* * * * *